United States Patent [19]

Herring

[11] Patent Number: 4,805,245

[45] Date of Patent: Feb. 21, 1989

[54] RINSING AND WASHING FIXTURE

[75] Inventor: William P. Herring, Bristol, Great Britain

[73] Assignee: Friedrich Grohe Armaturenfabrik GmbH & Co., Hemer, Fed. Rep. of Germany

[21] Appl. No.: 850,795

[22] Filed: Apr. 11, 1986

[30] Foreign Application Priority Data

Apr. 11, 1985 [DE] Fed. Rep. of Germany ..... 3512964

[51] Int. Cl.[4] ..... E03C 1/04

[52] U.S. Cl. ..... 4/192; 4/628; 251/242; 134/172

[58] Field of Search ..... 4/615, 628, 654, 191, 4/192, 203; 137/603, 878, 881, 801, 562; 251/231, 235, 244, 238, 239, 242; 134/172, 198; 239/580, 583, 525, 391; 128/66; 604/150, 249

[56] References Cited

U.S. PATENT DOCUMENTS

| | | | |
|---|---|---|---|
| 1,278,225 | 9/1918 | Schamberg | 4/615 |
| 2,129,816 | 9/1938 | Byars | 251/239 |
| 2,200,503 | 5/1940 | Judell et al. | 4/615 |
| 2,523,809 | 9/1950 | Bronk et al. | 604/249 |
| 2,971,520 | 2/1961 | Motis et al. | 4/615 |
| 3,169,254 | 2/1965 | Lantz et al. | 4/203 |
| 3,810,787 | 5/1974 | Yoelt et al. | 134/172 |

FOREIGN PATENT DOCUMENTS

| | | | |
|---|---|---|---|
| 1763663 | 12/1957 | Fed. Rep. of Germany . | |
| 2827847 | 1/1980 | Fed. Rep. of Germany . | |
| 3306946 | 8/1984 | Fed. Rep. of Germany . | |
| 421844 | 4/1967 | Switzerland | 4/615 |
| 854364 | 8/1981 | U.S.S.R. | 4/612 |

*Primary Examiner*—Henry J. Recla
*Assistant Examiner*—Linda J. Sholl
*Attorney, Agent, or Firm*—Herbert Dubno

[57] ABSTRACT

Water fittings for rinsing tables or the like include a hose pipe which is provided with a hose fiting having a casing which accommodates in downstream direction a shut-off valve for controlling the water flow and a fast coupling for providing a connection of the hose fitting with a hand appliance.

1 Claim, 4 Drawing Sheets

RINSING AND WASHING FIXTURE

FIELD OF THE INVENTION

My present invention relates to fixture for rinsing tables and the like and more particularly, to rinsing and washing fixtures which can be readialy maneuvered by hand and can be controlled remote from a hot/cold mixing unit.

BACKGROUND OF THE INVENTION

German patent publication No. DE-GM 1,763 663 describes a mixing fixtures which include a discharge pipe and hand shower or spray which is supplied with water via a separate hose or flexible pipe.

The hand-held spray is located next to the mixing-valve fixture on the rinsing table in a holder from which it can be removed during operation. By actuating a lever on the spray head, the water can selectively be discharged through the outlet spout of the mixing valve or faucet or through the hand-held spray head.

The German patent publication No. DE-OS 3,306,946 discloses a hand device which is connectable to a hose fitting via a rapid-engagement coupling which allows a connection of the hose or pipe to various appliances providing washing and rinsing of kitchen utensils.

OBJECT OF THE INVENTION

It is the principal object of my present invention to provide improved water fittings for rinsing tables or the like allowing a connection of a variety of hand appliances and controlling the discharge of water.

SUMMARY OF THE INVENTION

I realize this object according to the invention by providing a hose fitting connected to a hose pipe in a fixture and having a casing which accommodates in downstream direction a shut-off valve for controlling the water flow and a quick-engagement/quick-release coupling for allowing a connection of a hand appliance.

Preferably, the shut-off valve cooperates with an operating lever which projects through the casing towards the outside to allow actuation of the shut-off valve when the hand-held appliance is in the hand of the user. The operating lever is swingably mounted in the casing and includes an inner part extending essentially radially from the shut-off valve towards the outside and an outer part connected to the inner part and extending essentially parallel to the center axis of the casing outside the latter.

The hose fitting enables the hose pipe of a mixing valve to be connectable with a variety of different hand appliances like a hand shower, brush, pot scraper, filter device for the improvement of the taste of dispensed drinking water etc.

Simultaneously, the discharge of water is controlled in a convenient manner via the operating lever which extends in immediate proximity of and parallel to the handle of the connected hand appliance over substantially the entire length thereof.

Rinsing valves or faucets provided with separate hand showers can easily be equipped with hose fittings according to the invention so as to be usable with a variety of different hand appliances.

BRIEF DESCRIPTION OF THE DRAWING

The above and other objects, features and advantages of my present invention will become more readily apparent from the following description, reference being made to the accompanying drawing in which.

SPECIFIC DESCRIPTION

Figure 1:
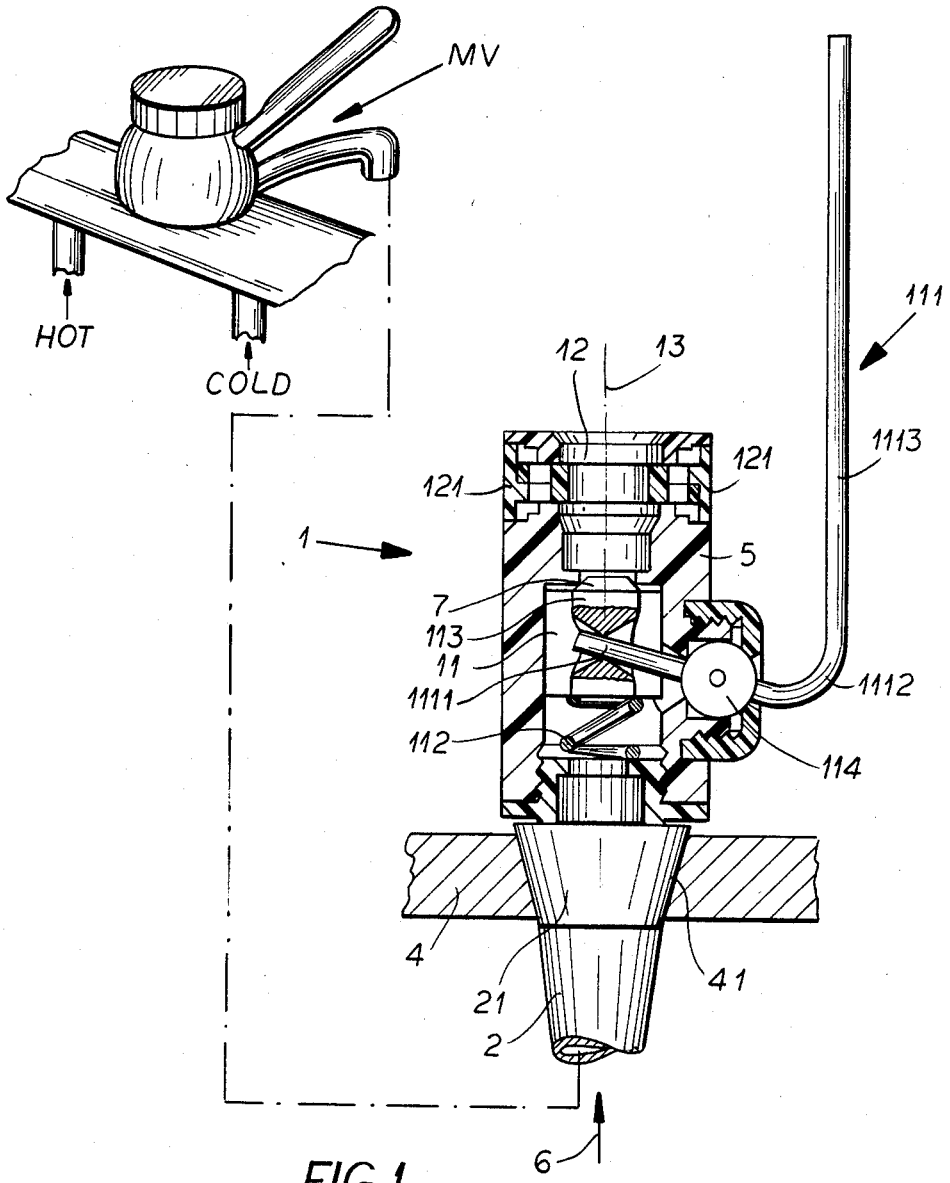
FIG. 1 is a partial longitudinal section through one embodiment of a hose fitting according to the invention.

FIG. 1, shows a hose fitting generally designated at 1 and connected to a hose pipe 2 which is part of or connected to a mixing battery MV for a rinsing table or the like.

The connection between the hose pipe 2 and the fitting 1 is obtained through a conical union nut 21 which rests in a matching conical opening 41 of a washstand 4 until the valve and an appropriate applicance are lifted therefrom for use. Thus, the fitting 1 can simply be placed into the opening 41 with the union nut 21 when not in use and removed therefrom during operation.

The hose fitting 1 includes a casing 5 which accommodates in the flow direction of the water as indicated by arrow 6 a shut-off valve 11 and a fast coupling 12. The shut-off valve 11 essentially includes a valve closure member 113 which is loaded by a spring 112 in closing direction against valve seat 7. The valve closure element 113 is controlled by an operating lever 11 which is swingably mounted via bearing 114 in sealing manner in the wall of the casing 5. The operating lever 111 has an inner portion 111 which projects essentially radially from the valve closure member 113 towards the outside and is connected to an outer portion 1113 via a bend 1112 in such a manner that an angle of about 90° is defined therebetween. The outer portion 1113 of lever 111 extends essentially parallel to the center axis 13 beyond the fitting 1 to allow actuation thereof and thus of the shut-off valve 111 when the fitting 1 is connected to various appliances as will be described hereinbelow. The portion 1113 lies parallel to the handle portions of the appliances used over substantially their entire lengths.

The fast coupling 12 located at the downstream end of the fitting 1 is of conventional design and corresponds essentially in structure and operation to the pipe fast coupling described in the German Pat. No. 2,827,847.

Figure 2:
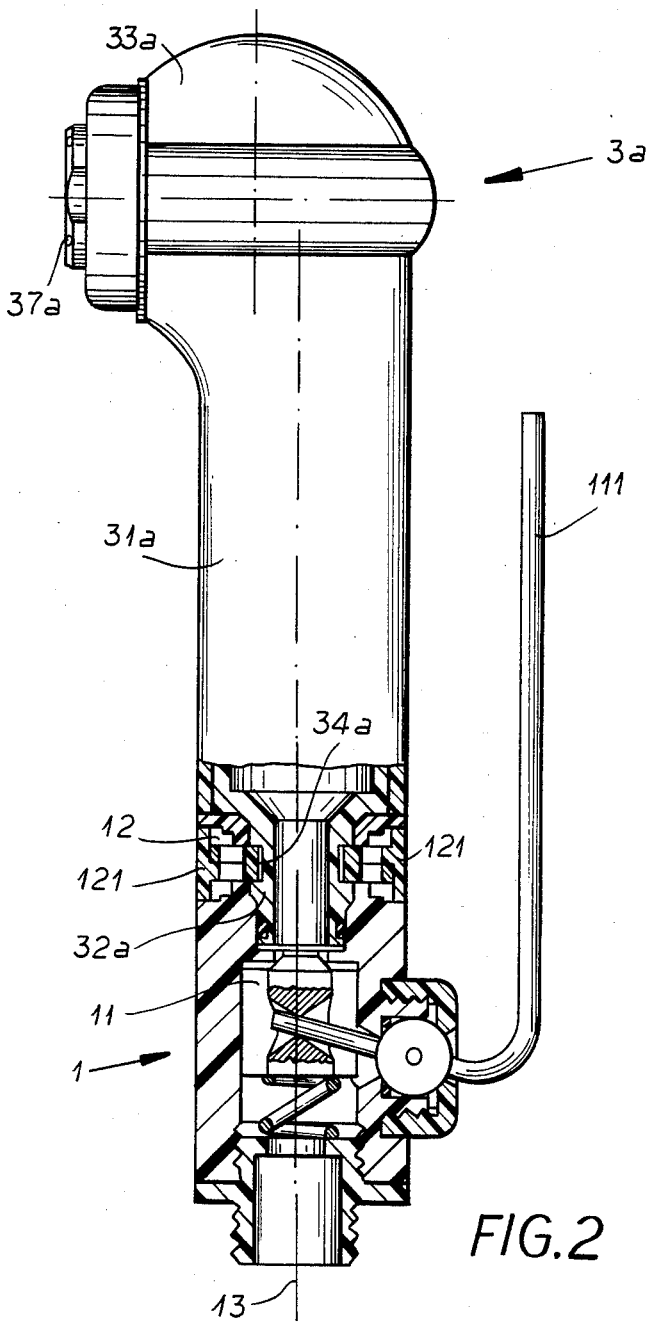
FIG. 2 is a partial sectional view of the hose fitting of FIG. 1 assembled to a hand spray or shower head.
Figure 3:
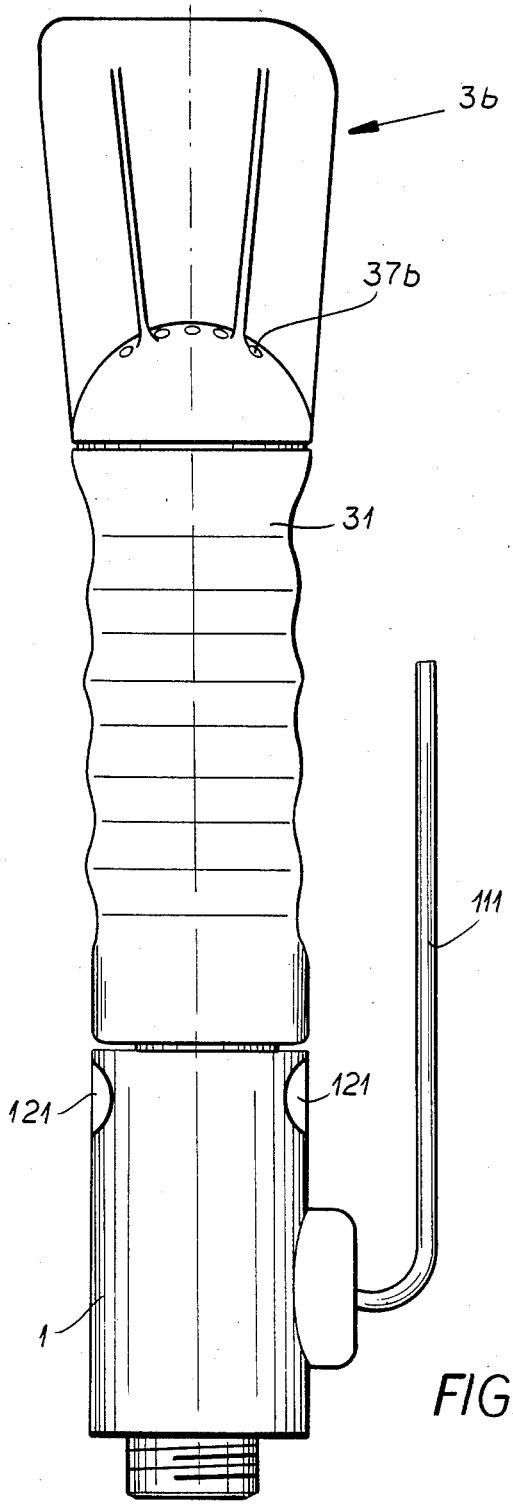
FIG. 3 is a schematic view of the hose fitting of FIG. 1 assembled to a pot scraper.
Figure 4:
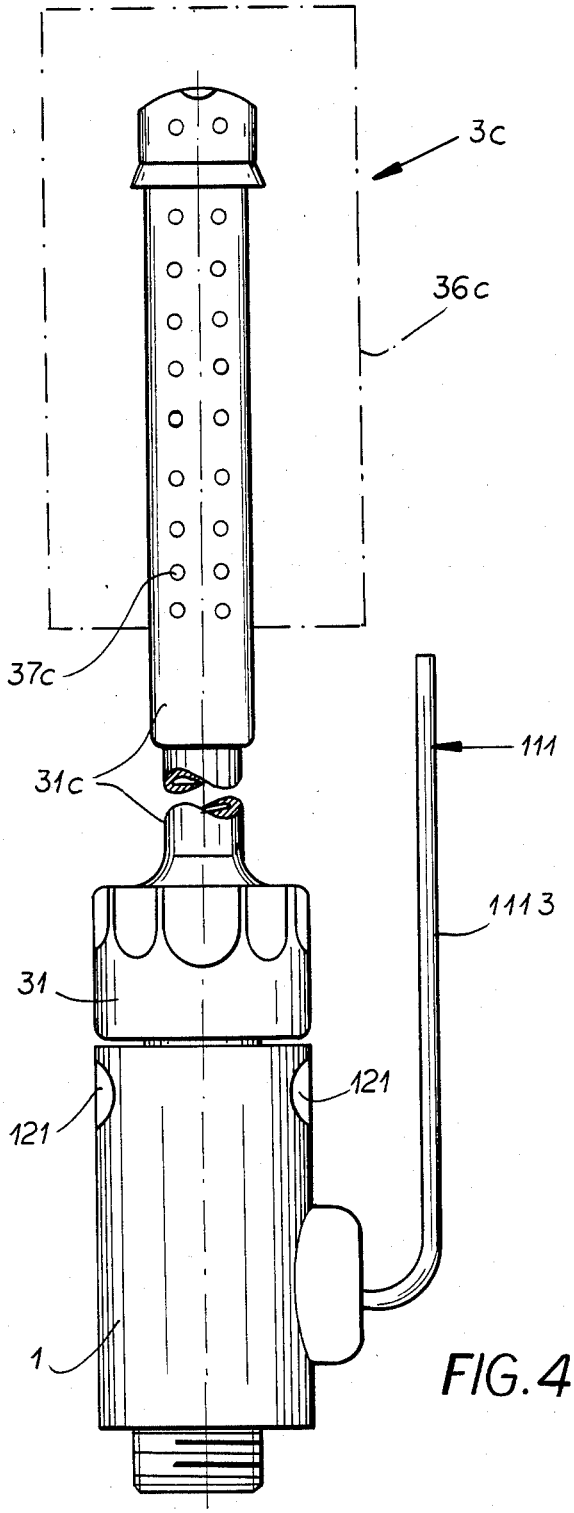
FIG. 4 is a schematic view of the hose fitting of FIG. 1 assembled to a bottle brush.

Turning now to FIGS. 2 to 4 which show various hand appliances generally designated by reference numerals **3*a*, 3*b* and 3*c* and connected to the fitting 1**.

In FIG. 2, the appliance **3*a* is a rinsing shower with a hollow handle 31*a* whose one end is connected to a shower head 33*a* and its other end is provided with a plug-in terminal 32*a* which includes an annular groove 34*a*. The plug-in terminal 32*a* is pushed coaxially with the center axis 13 of the fitting 1 into a corresponding socket of the fast coupling 12 and is detachably fixed by safety catches 121 which engage in the groove 34*a***.

In FIG. 3, the appliances **3*b* is a pot scraper with a corrugated hollow handle 31*b* while in FIG. 4 a bottle brush 3*c* is illustrated with a handle 31*c* and bristles 36*c*. Regardless what appliance 3 is connected to the fitting 1, the operating lever 111 extends in immediate proximity of the handles 31*a*, 31*b*, 31*c* so that the water flow through the shut-off valve 11 can easily be controlled by simultaneously gripping the handle 31***a*, 31*b* or 31*c* and the outer portion 1113 of the handle 111. Apparatus 37*a*, 37*b* and 37*c* are provided to discharge the water in the three appliances.

I claim:

1. A rinsing table water fixture, comprising:

a mixing valve for mixing hot and cold water and provided with means for mixing hot and cold water and for controlling the flow of mixed water;

a flexible hose connected to said mixing valve;

a fitting at an end of said hose remote from said mixing valve, said fitting including:

a valve casing having opposite ends, means for connecting said casing to said hose at one end of said casing, a push-on/pull-off quick-connect/quick-release coupling at an opposite end of said casing, and a shut-off valve between said ends of said casing, said shut-off valve including an axially movable valve member, a spring biasing said valve member against a seat in said casing to block water flow therethrough, a generally J-shaped lever having a short arm extending into said casing and a long arm extending alongside said casing generally parallel to an axis thereof and beyond said opposite end, and pivot means articulating said short arm on said casing, said short arm also engaging said valve member; and a set of hand-manipulatable appliances including at least a spray head, a pot scraper and a bottle brush each having a handle portion parallel to said axis and engageable in said coupling and selectively connectable to said casing, said long arm extending substantially over the lengths of said handle portions, each of said appliances having apertures for discharging water upon depression of said long arm toward a handle of one of said appliances engaging said coupling.

* * * * *